US008673118B2

(12) United States Patent
Görrel et al.

(10) Patent No.: US 8,673,118 B2
(45) Date of Patent: Mar. 18, 2014

(54) PRESS DEVICE WITH AN EXTENDED NIP, A PAPER MAKING MACHINE AND A METHOD OF OPERATING A PRESS DEVICE

(75) Inventors: Mats Görrel, Karlstad (SE); Karl-Johan Tolfsson, Forshaga (SE)

(73) Assignee: Valmet Aktiebolag, Sundsvall (SE)

( * ) Notice: Subject to any disclaimer, the term of this patent is extended or adjusted under 35 U.S.C. 154(b) by 0 days.

(21) Appl. No.: 14/000,141

(22) PCT Filed: Feb. 16, 2012

(86) PCT No.: PCT/SE2012/050172

§ 371 (c)(1),
(2), (4) Date: Sep. 18, 2013

(87) PCT Pub. No.: WO2012/112117

PCT Pub. Date: Aug. 23, 2012

(65) Prior Publication Data

US 2014/0000829 A1 Jan. 2, 2014

(30) Foreign Application Priority Data

Feb. 18, 2011 (SE) ..... 1150133

(51) Int. Cl.
*D21F 1/32* (2006.01)

(52) U.S. Cl.
USPC ..... 162/199; 162/272; 162/358.3; 162/358.5

(58) Field of Classification Search
USPC ..... 162/199, 272, 252, 358.3, 358.5; 100/153, 154; 72/238
See application file for complete search history.

(56) References Cited

U.S. PATENT DOCUMENTS 4,931,142 A 6/1990 Steiner et al.
5,018,960 A 5/1991 Singer (Continued)

FOREIGN PATENT DOCUMENTS

EP 2085513 A1 8/2009
WO WO 03/004889 A1 1/2003

(Continued)

OTHER PUBLICATIONS

International Searching Authority, International Search Report for Application No. PCT/SE2012/050172, mailed May 16, 2012, 6 pages, Swedish Patent and Registration Office, Sweden.

*Primary Examiner* — Mark Halpern
(74) *Attorney, Agent, or Firm* — Alston & Bird LLP

(57) ABSTRACT

The present invention relates to a press device (1) that comprises an extended nip roll (2) and a counter roll (3). The extended nip roll (2) has a flexible jacket (4) and a support body (5) inside the flexible jacket (4). The extended nip (2) roll also has internal means for causing the support body (5) to move or expand radially towards an inner surface (6) of the flexible jacket (4) to form a nip with the counter roll. The rolls (2, 3) have axial ends (7, 8, 10, 11) that are supported in bearing housings (9, 12). One or several actuators (13) such as hydraulic cylinders connects bearing housings (9, 12) to each other and the actuator or actuators (13) are arranged to act on the bearing housings (9, 12) to cause them to move to each other in a closing movement. A mechanical stop (14) which is separate from the rolls (2,3) is arranged to halt the closing movement. The invention also relates to a machine that uses the press device and to a method of operating the press device.

16 Claims, 12 Drawing Sheets

(56) References Cited

U.S. PATENT DOCUMENTS

| | | | |
|---|---|---|---|
| 5,098,523 | A | 3/1992 | Ilmarinen et al. |
| 5,547,547 | A | 8/1996 | Bengtsson |
| 5,693,186 | A | 12/1997 | Vallius |
| 6,010,443 | A | 1/2000 | Dahlbom et al. |
| 7,387,710 | B2 | 6/2008 | Bengtsson |
| 2004/0185171 | A1 | 9/2004 | Ueberschar et al. |

FOREIGN PATENT DOCUMENTS

| | | | |
|---|---|---|---|
| WO | WO 2005/038129 | A1 | 4/2005 |
| WO | WO 2005/038130 | A1 | 4/2005 |
| WO | WO 2010/036192 | A1 | 4/2010 |

PRESS DEVICE WITH AN EXTENDED NIP, A PAPER MAKING MACHINE AND A METHOD OF OPERATING A PRESS DEVICE

CROSS REFERENCE TO RELATED APPLICATIONS

This application is a national stage application, filed under 35 U.S.C. §371, of International Application No. PCT/SE2012/050172, filed Feb. 16, 2012, which claims priority to and the benefit of Swedish Application No. 1150133-5, filed Feb. 18, 2011, the contents of both of which are hereby incorporated by reference in their entirety.

BACKGROUND

1. Related Field

The present invention related to a press device with an extended nip, to a paper making machine having a press device and to a method of operating the press device.

2. Description of Related Art

In an extended nip press, a support body such for example a concave shoe is pressed against an inner surface of a flexible jacket. A counter roll is placed opposite the shoe in contact with an outer surface of the flexible jacket and the shoe and the counter roll form between them an extended nip. The pressure in the nip is typically caused by hydraulic pressure that acts to press the support body against the inner surface of the flexible jacket and thereby also against the counter roll. For example, most extended nip presses use one or several hydraulic jacks that press a concave shoe towards the counter roll. The pressure in the nip is then normally assumed to be a function of the pressure in the hydraulic jacks. In WO 2005/038129, an extended nip press device is disclosed with a support body that comprises a flexible hose that is placed in a channel (groove) in a holding device. The flexible hose is connected to a source of pressurized fluid such that the flexible hose can be pressurized. When this happens, the flexible hose expands in its channel such that a top surface of the flexible hose is pressed against the inner surface of the flexible jacket. The pressure in the nip depends on the degree of deformation (expansion) of the flexible hose that forms the support body and the deformation depends on how much the flexible hose has been pressurized. In theory, it is then possible to achieve a desired pressure simply by pressurizing the flexible hose to a predetermined degree. In practice, however, it has been found that it may be difficult to establish the actual pressure in the nip. One reason for this may be a hysteresis effect when the hydraulic pressure is reduced—reduction of the hydraulic pressure does not necessarily cause the flexible hose to become correspondingly smaller. For this reason, it may be difficult to know with certainty the exact value of the pressure in the press nip. Another press device is disclosed in EP 2085513. In that press, the support body is not formed by a flexible hose but instead supported by a flexible hose or by two flexible hoses. Also in such a press device, it appears reasonable to assume that substantially the same problem can occur.

When the exact pressure in the press nip is unknown, there is a risk that the linear load reaches and exceeds the maximum permissible level. When this happens, the rolls may be damaged. In the worst case, this could have very serious consequences and even be dangerous to personnel in the area near the press device.

Another problem is that, even if the maximum permissible pressure is not exceeded, the actual pressure in the nip could be at a level that deviates from the level that best suits the process.

BRIEF SUMMARY

Therefore, it is an object of the invention to provide a press device where it is possible to ensure that the maximum pressure will not exceed a predetermined level even if the exact loading of the support body is not known or not accurately controlled.

Another objective of the invention is to provide a press device in which it is possible to accurately determine and control the pressure in the press nip even when the exact position or loading of the support body is unknown.

In connection with press devices using extended nip rolls, the counter roll may be a heated roll. If, for any reason, the press device must be stopped during operation, heat from the heated roll may cause damage to a felt passing through the press. Therefore, it is also a further object of the present invention to provide a press device where such damage to the felt can be avoided in case the press device must be stopped.

These and other objects are attained through the present invention as will be explained in the following.

The invention relates to a press device comprising an extended nip roll and a counter roll. The counter roll is preferably a heatable roll. The extended nip roll comprises a flexible jacket and a support body inside the flexible jacket. The extended nip roll has also internal means for causing the support body to move or expand radially towards an inner surface of the flexible jacket to form a nip with the counter roll. The counter roll has axial ends supported in first bearing housings and the extended nip roll having axial ends supported in second bearing housings. According to the invention, at least one actuator connects the first bearing housings to the second bearing housings. The at least one actuator is arranged to be capable of acting on the bearing housings to cause the bearing housings of at least one of the rolls to move towards the bearing housings of the other roll in a closing movement or away from the bearing housings of the other roll in an opening movement. A mechanical stop is arranged to halt the closing movement when the closing movement has brought the rolls so close to each other that the axial ends of the extended nip roll and the axial ends of the counter roll are at a predetermined distance from each other.

The mechanical stop is separate from the rolls, i.e. it is not formed by the rolls. Therefore, it may be capable of halting the closing movement before the outer surfaces of the rolls have come into contact with each other, at least when the support body has not been cause to move or expand radially outwards. The at least one actuator is preferably a hydraulic cylinder (or several hydraulic cylinders) but other actuators could also be used. For example, the actuator or actuators could be pneumatic cylinders or electric actuators.

The mechanical stop may be formed by at least a part of the bearing housing for each axial end of a roll.

If the actuator is a hydraulic cylinder, the mechanical stop may be a stop that is arranged to halt the piston before the piston has reached a completely retracted position.

In advantageous embodiments of the invention, the mechanical stop may comprise at least one load sensor that is arranged between one of the first bearing housings and one of the second bearing housings. However, embodiments without such a load sensor are conceivable.

When such a load sensor is used, the load sensor will be subjected to a force when the at least one actuator acts to move the bearing housings of one roll towards the bearing housings of the other roll.

Preferably, the support body either comprises, is formed by or is supported by a flexible hose extending in a cross machine direction and connected to a source of pressurized fluid such that pressurization of the flexible hose will cause the support body to expand or move radially in a direction towards the inner surface of the jacket.

In advantageous embodiments of the invention, an actuator is connected to each bearing housing of a roll.

The rolls have axes that define a press plane and preferably, the actuator or actuators are arranged to act on one side of the press plane while the bearing housings are hingedly connected to each other on the other side of the press plane.

In embodiments of the invention, the press device is designed such that, at each roll end, the at least one actuator is connected to the respective second bearing housing through a connection beam that is hingedly connected to the first bearing housing at a first end of the connection beam and hingedly connected to the at least one actuator at a second end of the connection beam.

The at least one actuator may be hingedly connected to the first bearing housing and to the second end of the connection beam.

In advantageous embodiments, the press device may be designed such that, at each roll end, the connection beam is detachably connected to the second bearing housing.

Preferably, the extended nip roll is a lower roll and the counter roll is an upper roll.

The invention also relates to a paper making machine having a head box and a press device according to the present invention.

The invention may also be understood in terms of a method for operating a press device. The invention can also be understood in terms of a method of determining and controlling the pressure in the nip.

The invention can also be understood in terms of a method for opening a press nip.

DETAILED DESCRIPTION OF VARIOUS EMBODIMENTS

Figure 1:
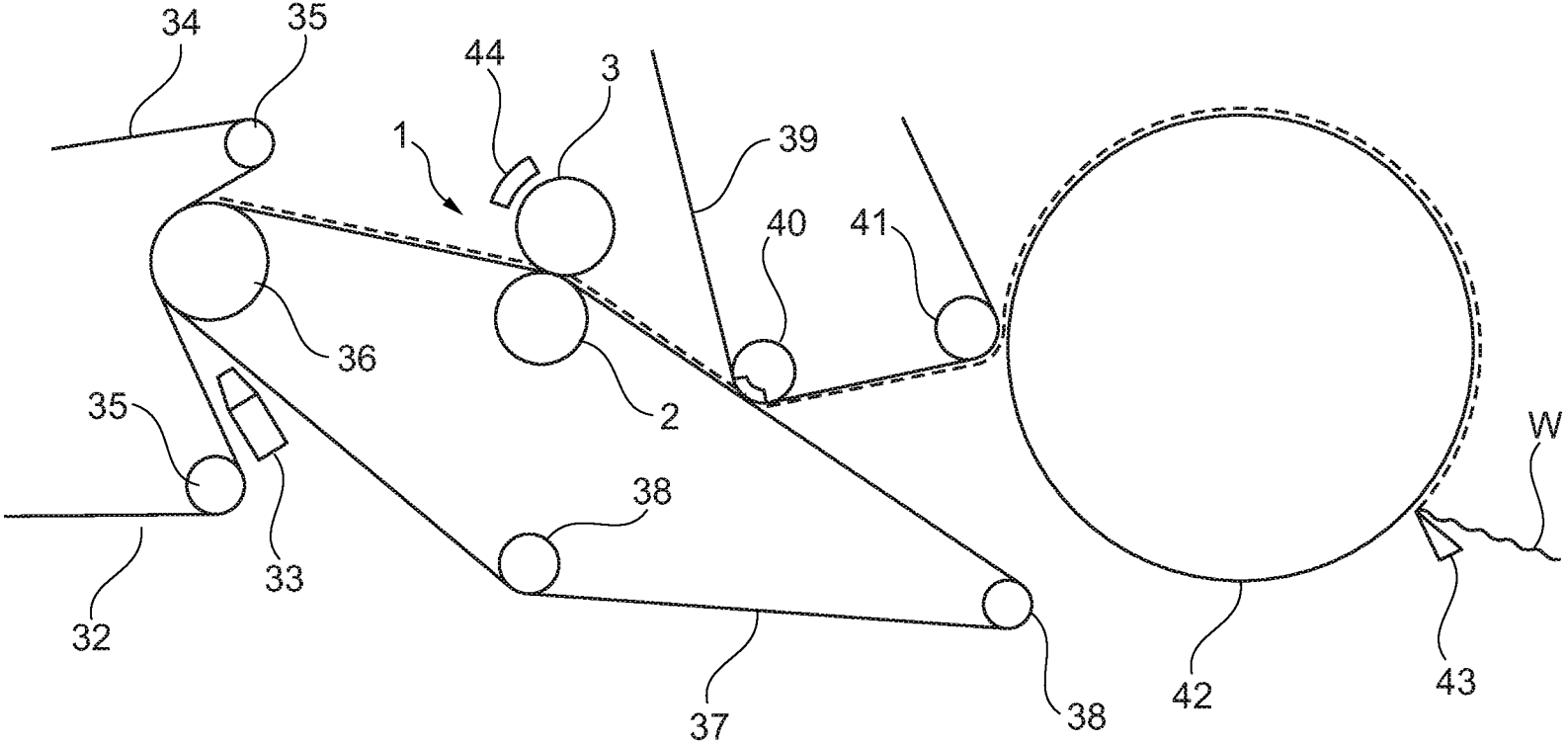
FIG. 1 is a schematic representation of a paper making machine with a press device.

With reference to FIG. 1, an example of a paper making machine is shown in which the inventive press device may be used. The paper making machine of FIG. 1 comprises a forming section 32 where a head box 33 is arranged to inject stock into a gap between a forming wire 34 an a second fabric 37 that may be a felt 37. In the forming section, a web W is formed. In FIG. 1, the forming wire 34 is guided by guide rolls 35 while the felt 37 is guided by guide rolls 38. The reference numeral 36 refers to a forming roll. The felt 37 is arranged such that is runs through a press device 1 in which water is removed from the newly formed wet web W. The press device 1 comprises an extended nip roll 2 and a counter roll 3 which may be a heatable roll. A heating device 44, for example an induction heater 44, may be arranged to heat the counter roll 3 such that the heat energy may contribute to dewatering of the newly formed wet web W. In the embodiment of FIG. 1, an air permeable pick-up felt 39 is arranged to pick up the web W from the felt 37 and transfer the web W to a Yankee cylinder 42. The reference numeral 40 refers to a suction roll that can act through the pick-up felt 39 to such the web W against the pick-up felt 39. A roll 41 forms a transfer nip with the Yankee cylinder 42. The web W may then be creped from the Yankee cylinder by a doctor 43 as is conventional in the art.

The extended nip roll 2 may, in principle, be a roll of the kind that comprises a rigid shoe and a row of hydraulic cylinders arranged to press the shoe against the counter roll. A known such roll is the SymBelt roll which is sold by Metso Paper Inc. An example of a shoe press with a shoe and a row of cylinders is also disclosed in, for example, U.S. Pat. No. 7,387,710.

However, if the paper machine is a machine for making tissue paper, another kind of extended nip roll may be used in which the support body is formed by a flexible material and has an inner cavity that may be filled with pressurized fluid. Such an extended nip roll is disclosed in, for example, WO 2005/038129. Such a device is also sold by Metso Paper Karlstad AB under the name Advantage™ ViscoNip press.

Figure 2:
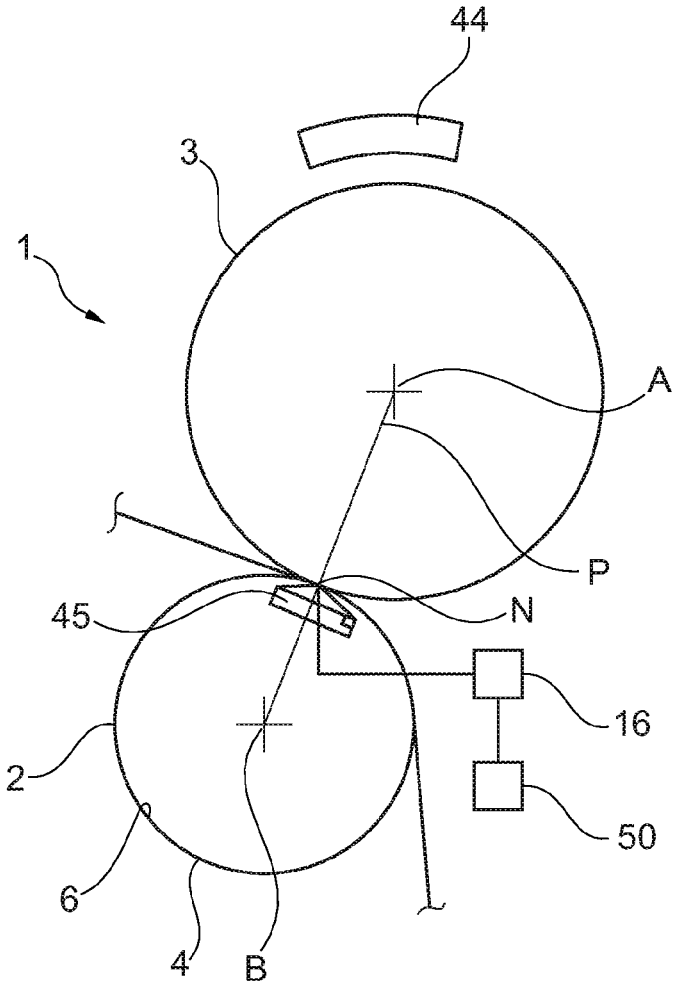
FIG. 2 is a schematic representation of a press nip in a paper making machine.
Figure 3:
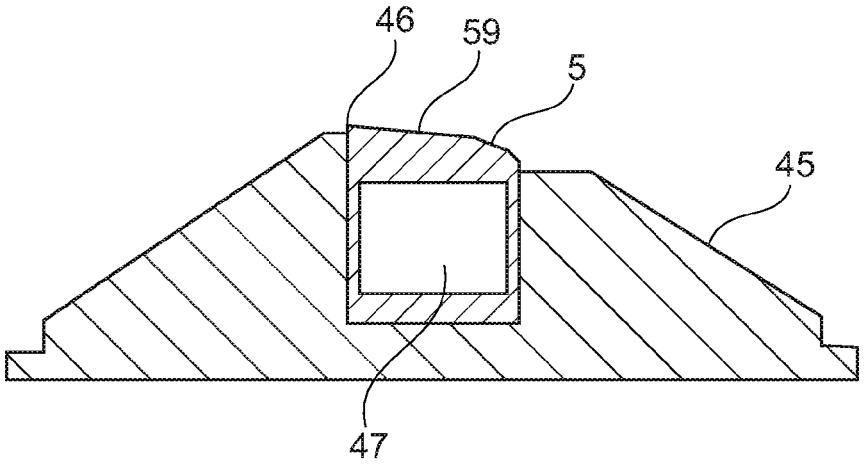
FIG. 3 shows a cross section of a support body arrangement used in the press nip of FIG. 2.

With reference to FIG. 2 and to FIG. 3, the press device 1 may have an extended nip roll that is designed substantially as described in WO 2005/038129. The extended nip roll 2 has a support body 5 which is placed in a groove 46 of a holder 45. The support body 5 is formed as a flexible hose and has an internal chamber 47 that can be filled with pressurized fluid (for example pressurized oil or some other hydraulic fluid). The pressurized fluid may be supplied from a source 16 of pressurized fluid. The source 16 of pressurized fluid may be located outside the extended nip roll 2 and the flow of pressurized fluid from the source 16 may be controlled by a control device 50. The support body 5 has an upper surface 59. The support body 5 may be made of an elastic material such as rubber. When pressurized fluid is supplied from the source 16 of pressurized fluid, the pressure in the internal chamber 47 will rise which will cause the support body to expand out of the groove 46. As a consequence, the upper surface 59 of the support body will move radially outwards. Thereby, it will move towards the inner surface 6 of the flexible jacket 4 such that the flexible jacket 4 can be pressed against the counter roll 3. Thereby, pressure can be generated in the press nip N if the counter roll 3 is located adjacent the extended nip roll 2.

It will be understood that, as in any extended nip roll, the flexible jacket 4 forms a loop and the support body 5 is located inside the loop. The flexible jacket 4 has a generally tubular shape. It should be understood that, as is common in the art, the flexible jacket 4 has axial ends that may be secured to end walls that can rotate. Such arrangements are disclosed in, for example, U.S. Pat. No. 5,098,523 and U.S. Pat. No. 6,010, 443.

The flexible jacket 4 is preferably liquid impermeable. The extended nip roll may comprise means for supplying a lubricant to the inner surface of the flexible jacket 4 to reduce friction between the flexible jacket 4 and the support element 5. The flexible jacket 4 may be made (entirely or in part) of, for example, polyurethane. The extended nip roll may optionally comprise means (not shown) to supply pressurized gas (e.g. air) to the interior of the extended nip rill such that the flexible jacket 4 is inflated (has internal gas pressure).

Figure 4:
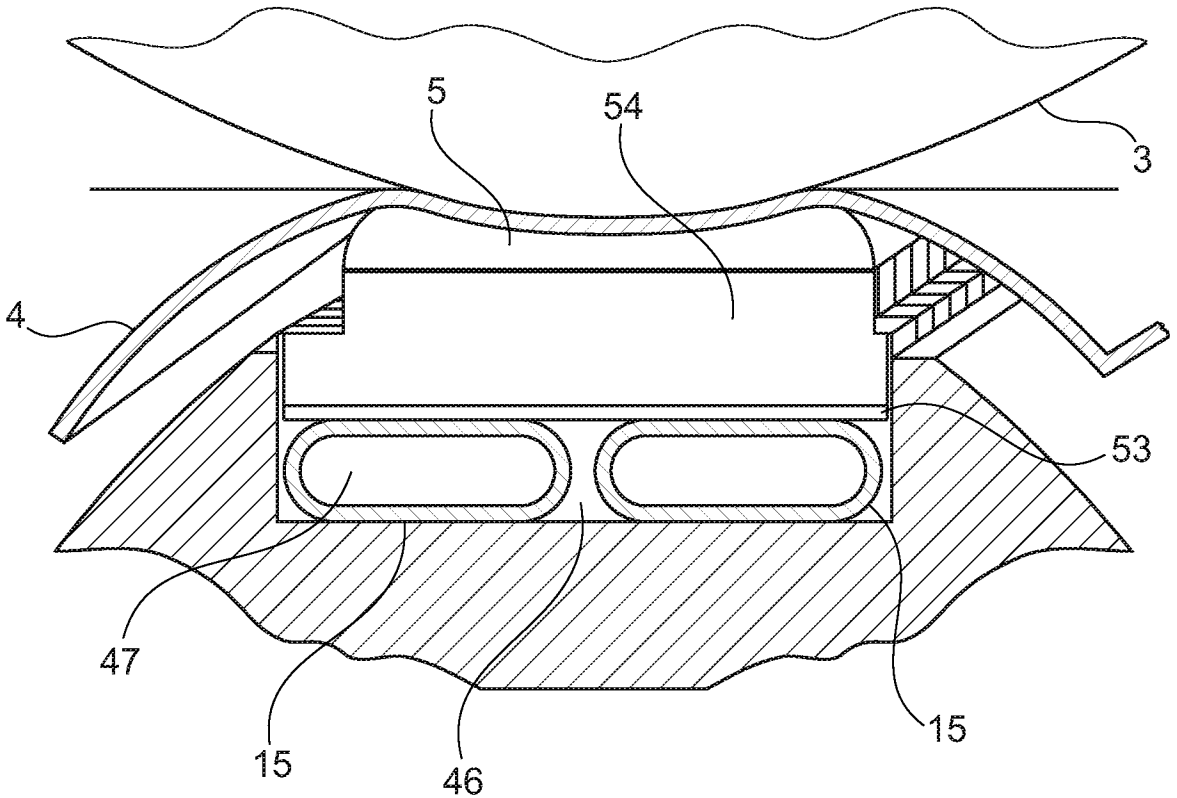
FIG. 4 shows a cross section of yet another support body arrangement

Another possible design of an extended nip roll which may be used for the press device of the present invention is disclosed in EP 2085513. An extended nip substantially as disclosed in that publication will now be explained with reference to FIG. 4 of the present application. In the embodiment of FIG. 4, the support body 5 is not itself formed by a flexible hose. Instead, the support body 5 is a shoe which may have a concave surface that matches the (convex) outer contour of a counter roll 3. The radius of curvature of the concave surface of the support body 5 in FIG. 4 is somewhat larger than the radius of curvature of the counter roll 3. Thereby, there is room for a felt 37 and a flexible jacket 4 to pass between the counter roll 3 and the support body 5. The support body 5 may advantageously have a degree of flexibility such that, if necessary, it can adapt to the contour of the counter roll 3. The support body 5 rests on one or two flexible hoses 15 each of which has an internal chamber 47 that can be filled with pressurized fluid as described previously with reference to FIG. 2. The flexible hose or hoses 15 can be made of an elastic material, for example rubber or a material with properties similar to rubber. When the flexible hose or flexible hoses 15 is/are filled with pressurized fluid, it/they will expand such that the support body 5 will be pressed radially outwards toward the counter roll 3. A flexible sheet 53 and a set of intermediate pieces 54 may be placed between the support body 5 and the flexible hose(s) 15 as described in EP 2085513.

The internal chamber 47 of the support body 5 or the flexible hose(s) 15 is an internal means for the causing the support body to expand or move towards the inner surface of the flexible jacket 4. The upper surface 59 of the support body 5 can thus be caused to move towards the inner surface 6 of the flexible jacket such that the jacket 4 is pressed against the counter roll even if the extended nip roll as such does not move. In the embodiment of FIG. 3, the support body is caused to expand radially toward the counter roll 3. In the embodiment of FIG. 4, it is not the support body 5 itself that expands. Instead, the support body 5 moves radially outwards towards an inner surface 6 of the flexible jacket 4 to form a nip with the counter roll 3.

Figure 5:
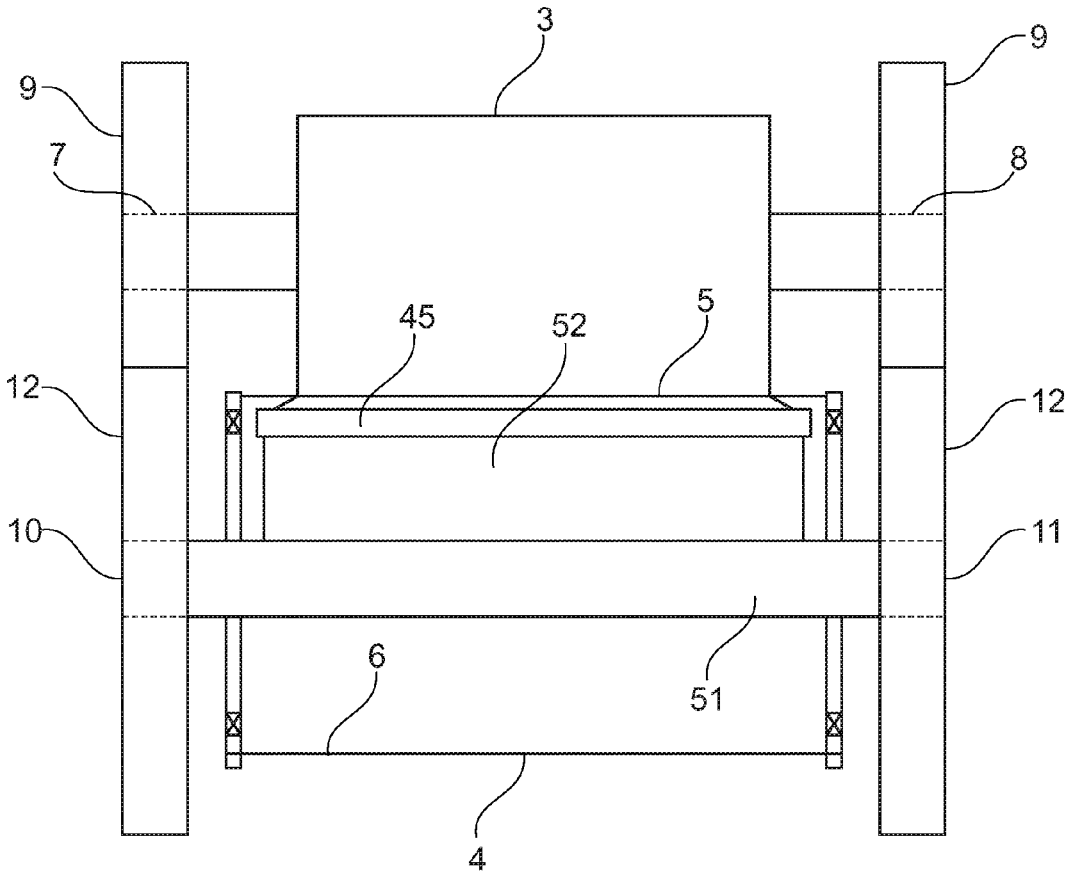
FIG. 5 shows, schematically, a front view, partially in cross section, of a press device according to the present invention.

With reference to FIG. 5, the counter roll 3 has axial ends 7, 8 that are supported in first bearing housings 9. The extended nip roll 2 has axial ends 10, 11 that are supported in second bearing housings 12. FIG. 5 may, in principle, correspond to the press device of any of FIG. 3 or FIG. 4. In FIG. 5, the reference numeral 51 indicates a support beam for an extended nip roll 2 while 52 represents a support for the holder 45. It should be understood that FIG. 5 is a highly schematic representation of a press device with an extended nip roll and that the actual design of the extended nip roll may take many different forms.

For the kind of extended nip rolls described above with reference to FIGS. 2-4, it may sometimes be difficult to know the actual pressure in the nip N. A reason for this is that, when the hydraulic pressure in the internal chamber 47 is reduced, this does not necessarily result in a corresponding reduction of the nip pressure. A hose made of an elastic material may very well retain its shape for a substantial time after the pressure has been reduced. Moreover, the shape of the hose does not necessarily change as a linear function of the hydraulic pressure. One consequence of this may be that, in some situations, it is difficult to know if the linear load exceeds the maximum permissible linear load. If the linear load becomes too high, this may damage the counter roll.

The present invention provides a solution to this problem.

Figure 6:
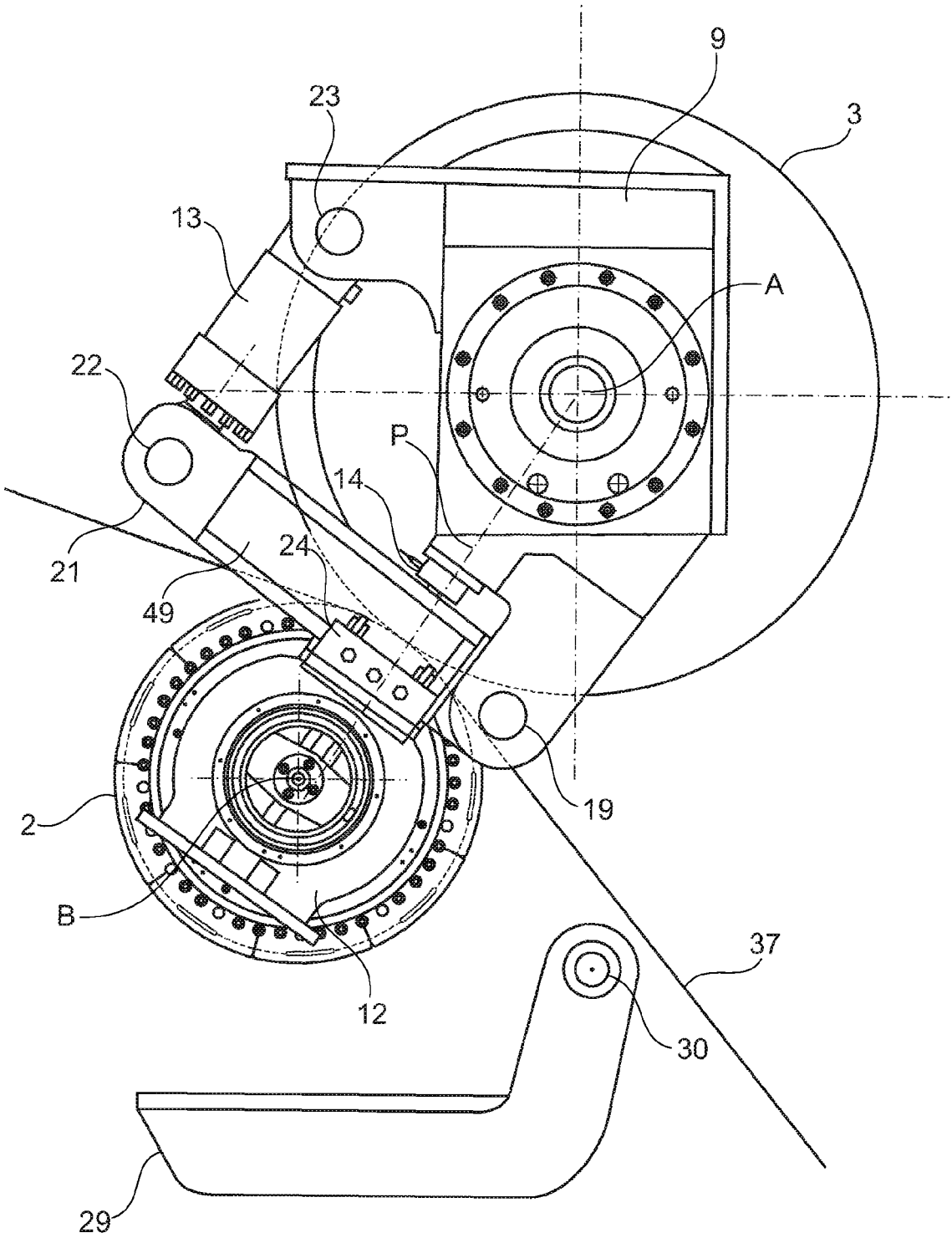
FIG. 6 is a side view of a press device according to the present invention.

The inventive press device will now be explained with reference to FIG. 6. As explained with reference to FIG. 5, the counter roll 3 has roll ends 7, 8 that are supported in first bearing housings 9. In FIG. 6, only one end of the press device 1 (the side at the axial end 7 of the counter roll) can be seen but it should be understood that the arrangement on the other side of the press device (i.e. at the side of the other axial end 8 of the counter roll) is similar. In the same way, the extended nip roll has roll ends 10, 11 that are supported in second bearing housings 12. The axes A, B of the rolls 2, 3 can be seen as defining a press plane P. The forces in the press nip act in the press plane. The axis A, B of a roll is the axis around which the roll rotates. With reference to the extended nip roll 2, this means substantially the axis around which the flexible jacket 4 rotates.

It should be understood, however, that for some extended nip rolls 2, the axis about which the flexible jacket 4 rotates may be slightly eccentric with regard to the plane in which the resultant force in the nip acts. Such an extended nip roll with an eccentric flexible jacket 4 is disclosed in, for example, U.S. Pat. No. 4,931,142. When the rotational axes A, B are used to define the press plane P, it should thus be understood that this is for convenience and for the purpose of defining what lies upstream or downstream of the press nip P. A slightly different way of defining the press plane may be that the press plane is simply the plane in which the resultant force in the press nip P is acting.

The first bearing housings 9 are connected to/coupled to the second bearing housings 12 as will be explained in the following. According to the invention, at least one actuator 13 connects the first bearing housings 9 to the second bearing housings 12. Preferably, an actuator 13 is connected to each one of the first bearing housings 9. However, embodiments are conceivable where one single actuator 13 is connected to both of the first bearing housings 9 and arranged to act on them both. The at least one actuator 13 is arranged to be capable of acting on the bearing housings 9, 12 to cause the bearing housings 12 of at least one of the rolls 2 to move towards the bearing housings 13 of the other roll 3 in a closing movement or away from the bearing housings of the other roll 3 in an opening movement; and in that a mechanical stop 14 which is separate from the rolls 2, 3 is arranged to halt the closing movement when the closing movement has brought the rolls 2, 3 so close to each other that the axial ends 10, 11 of the extended nip roll 2 and the axial ends 7, 8 of the counter roll 3 are at a predetermined distance from each other. That the mechanical stop 14 is separate from the rolls should be understood as meaning that it is not formed by the surfaces of the rolls 2, 3 but that it is capable of halting the closing movement before the surfaces of the rolls 2, 3 come into contact with each other.

When the mechanical stop 14 has halted the closing movement, there is normally still a certain distance between the outer surface of the counter roll 3 and the flexible jacket 4, there may thus a gap that separates the rolls 2, 3 from each other. This small gap can be closed when the support body 5 is pressed radially outwards or caused to expand radially outwards such that the flexible jacket 4 is pressed in a direction towards the counter roll 3. However, embodiments are conceivable where the mechanical stop 14 is arranged such that there is a degree of contact between the rolls 2, 3 before the mechanical stop 14 halts the closing movement. However, in preferred embodiments of the invention, the closing movement is halted while there is still a small gap that must be closed by activation of the support body 5 such that the flexible jacket 4 is pressed radially outwards to meet the outer surface of the counter roll 3.

The at least one actuator 13 is preferably a hydraulic cylinder. Suitable hydraulic cylinders can be obtained from many manufacturers, for example Nurmi Hydraulics OY, Finland. In practical embodiments contemplated by the inventors, the at least one actuator 13 may be a hydraulic cylinder with a stroke length of 50 mm-500 mm, preferably 70 mm-150 mm. For example, the inventors have contemplated one embodiment where the at least one actuator 13 may be a hydraulic cylinder with a diameter of 250 mm and a maximum stroke length of 130 mm (other dimensions are of course possible). The actually available stroke length for the closing movement (i.e. as limited by the mechanical stop) will of course be somewhat shorter. For example, if the maximum strike length of the at least one actuator 13 is 130 mm, the mechanical stop 14 may be placed and arranged such that, during the closing movement of the actuator 13, the closing movement is halted by the mechanical stop when only 120 mm of the total stroke length has been used such that 10 mm stroke length remains. The at least one actuator 13 will therefore continue to press the bearings housings 9, 12 toward each other even though this movement has been halted.

In many practical embodiments, at least two actuators 13 are used (for example two hydraulic cylinders). In such embodiments, a first actuator 13 may connect the first and second bearing housings 9, 12 on the drive side of the machine to each other while a second actuator 13 may connect the bearing housings 9, 12 on the tender side of the machine. Such a design would normally be a preferred embodiment. However, embodiments are conceivable where one single actuator 13 is used. The first bearing housing 9 on the drive side of the machine could be rigidly connected by a beam or axle that extends in a cross machine direction to the first bearing housing 9 on the tender side of the machine while the second bearing housings 12 were also connected to each other in the same way. The at least one actuator 13 could then be connected at both its ends to the beams or axles connecting the bearing housings 9, 12 on the drive side of the machine to the bearing housings 9, 12 on the tender side of the machine. Thereby, the actuator 13 would connect the first bearing housings 9 to the second bearing housings 12.

The embodiments that will be described in the following and with reference to the drawings are embodiments where at least two actuators 13 are used (i.e. at least one actuator 13 on the drive side and at least one actuator 13 on the tender side). It should also be understood that, in principle, more than one actuator 13 may act on each side of the machine.

In the embodiment of FIG. 6, the at least one actuator 13 is connected at one end to the first bearing housing 9 by a hinge connection 23. At another end, it is connected by a hinge 22 to a connection beam 49 which in turn is connected to the second bearing housing 12. A hinge connects a first end 20 of the connection beam 49 to the first bearing housing on each side. In the embodiment shown in FIG. 6, the connection beam 49 may be an element that is removably attached to the second bearing housing 12 and thus forms an extension of the second bearing housing 12. It should be understood that the removably attached connection beam 49 is an optional element and that embodiments without such a removable connection beam 49 are conceivable such that the actuator is directly connected to the second bearing housings 12. The actuator 13 can thus be directly connected to the second bearing housing 12 itself or indirectly connected to the bearing housing 12 through an intermediate piece such as the removable connection beam 49. It should also be understood that embodiments are conceivable where the connection beam 49 is an integral part of the second bearing housing 12 itself. In such embodiments, the at least one actuator 13 may be directly connected to the second bearing housing 12, for example through a hinge connection.

Since the first bearing housings 9 are connected to the second bearing housings 12 by means of the at least one actuator 13 and the hinges 19, the forces from the press nip do not have to be transmitted through a heavy frame.

In the embodiment shown in FIG. 6, the first bearing housings 9 may be in a fixed position. For example, the may be fixedly connected to a machine frame (not shown) such that they retain their position. Consequently, the counter roll 3 will also be in a fixed position. In this embodiment, the second bearing housings 12 are movable together with the extended nip roll 2 that is supported by the second bearing housings 12. The at least one actuator 13 can be activated such that it is shortened and thereby causes the extended nip roll 2 to move toward the counter roll 3. In the embodiment of FIG. 6, this takes place in such a way that the connection beam 49 turns around a hinge 19 that connects the connection beam to the first bearing housing 9 (the connection beam will thus turn clockwise in FIG. 9). The second bearing housing 12 will thus move toward the first bearing housing 9 in a turning movement.

In preferred embodiments of the invention, the mechanical stop 14 is formed by at least a part of the bearing housing 9, 12 for each axial end 7, 8, 10, 11 of a roll 2, 3. In the embodiment shown in FIG. 6, the mechanical stop 14 is formed by a projecting part on the first bearing housing 9 on each side of the press device. The mechanical stop 14 projects from the first bearing housing 9 and faces the second bearing housing 12. When the actuator(s) 13 act(s) to bring the second bearing housings 12 closer to the first bearing housings 9, the mechanical stop 14 on the first bearing housing 9 will meet the second bearing housing 12, either by direct contact with the second bearing housing 12 or by contact with an intermediate piece such as the connection beam 49. This will halt the movement of the second bearing housings 12 in a position where the at least one actuator 13 is still acting on the second bearing housings 12 to press them towards the first bearing housings. In preferred embodiments of the invention, this takes place when, in an unloaded condition of the extended nip roll, there is still a short distance between the extended nip roll 2 and the counter roll 3. This distance may normally be in the range of 0.5 mm-5 mm. The expression "an unloaded condition of the extended nip roll" refers to a state in which the support body 5 has not yet been pressed against the inner surface of the flexible jacket 4.

If the extended nip roll 5 is unloaded when the mechanical stop 14 halts the closing movement, the small gap between the rolls 2, 3 can be closed when the support body 5 is pressed against the inner surface 6 of the flexible jacket 6. This may happen when, for example, an internal chamber 47 of the support body 5 is pressurized (see FIG. 3) or when the internal chamber 47 of a flexible hose 15 on which the support body 5 is resting is pressurized (see FIG. 4). When the support body 5 is pressed against the inner surface of the flexible jacket 4, the flexible jacket 4 will be pressed radially outwards in a direction towards the counter roll 3. When the pressure in the internal chamber 47 is sufficiently high, the nip will be closed such that the felt 37 and the web W are pressed between the counter roll 3 and the extended nip roll 2. The first bearing housings 9 are connected to the second bearing housings 12 by the at least one actuator 13 such that the linear load in the nip is actually transmitted through the at least one actuator 13. The more the support body 5 is pressed in a direction towards the counter roll 3, the more the linear load increases. However, if the linear load becomes so high that the forces in the press nip should exceed the force from the at least one actuator 13, the at least one actuator 13 can no longer keep the bearing housings 9, 12 together. What happens then is that the second bearing housings 12 will start to move away from the first bearing housings 9. Thereby, the linear load in the press nip will be prevented from rising above this level.

It should be understood that, with relation to a roll, the expression "radially outwards" means a direction away from the axes A, B of the roll. The axis A, B of a roll is the axis around which the roll rotates. With reference to the extended nip roll, that means substantially the axis around which the flexible jacket 4 rotates even though some extended nip rolls are designed such that the flexible jacket 4 rotates about an axis that is slightly eccentric (i.e. slightly offset) in relation to the plane in which the resultant nip force is acting. In practice, the axis of rotation A, B of a roll is normally an axis that coincides with (or nearly coincides with) the axial ends 7, 8, 10, 11 of the rolls 2, 3.

The inventive press device thus allows that the closing movement is halted by the mechanical stop 14 before the flexible jacket 4 of the extended nip roll 2 comes into contact with the outer surface of the counter roll 3 (assuming the support body 5 is in its unloaded state where the chamber 47 has not been pressurized). Thereafter, the support body 5 can be pressed radially outwards to close the nip. It should be noted that, when the mechanical stop 14 halts the closing movement, the at least one actuator 13 is still acting to perform a closing movement, i.e. it exerts a force that presses at least one pair of bearing housings against the other pair of bearing housings. For example, in the embodiment of FIG. 6, the at least one actuator 13 acts to press the second bearing housings 12 towards the first bearing housings 9, even after the mechanical stop 14 has halted the closing movement.

It will be understood that the force in the at least one actuator 13 can then be set to a predetermined level where the maximum linear load in the press nip will not be exceeded. In this way, it is thus possible to ensure that the maximum linear load is never exceeded.

It should be understood that the technical problem of limiting the maximum linear load can be solved by the invention even if the rolls 2, 3 should come into contact with each other before the mechanical stop 14 halts the closing movement. For example, if the support body 5 of FIG. 3 has been pressurized to a certain degree and pressed the flexible jacket 4 radially outwards, the rolls 2, 3 may close the nip before the mechanical stop 14 has halted the closing movement of the second bearing housings 12. This means that the linear load may increase also during the last phase of the closing movement (i.e. until the mechanical stop 14 halts the closing movement) as long as the linear load does become so high that the total force in the nip exceeds the force generated by the at least one actuator.

In advantageous embodiments of the invention, the mechanical stop 14 may be formed by a load sensor which is arranged between the first bearing housing 9 and the second bearing housing 12 in the way shown in FIG. 6 and FIG. 8-FIG. 10. In such embodiments, the load sensor (the mechanical stop 14) will be subjected to a force when the at least one actuator 13 acts to move the second bearing housings 12 towards the bearing housing 9 of the counter roll 3.

Figure 13:
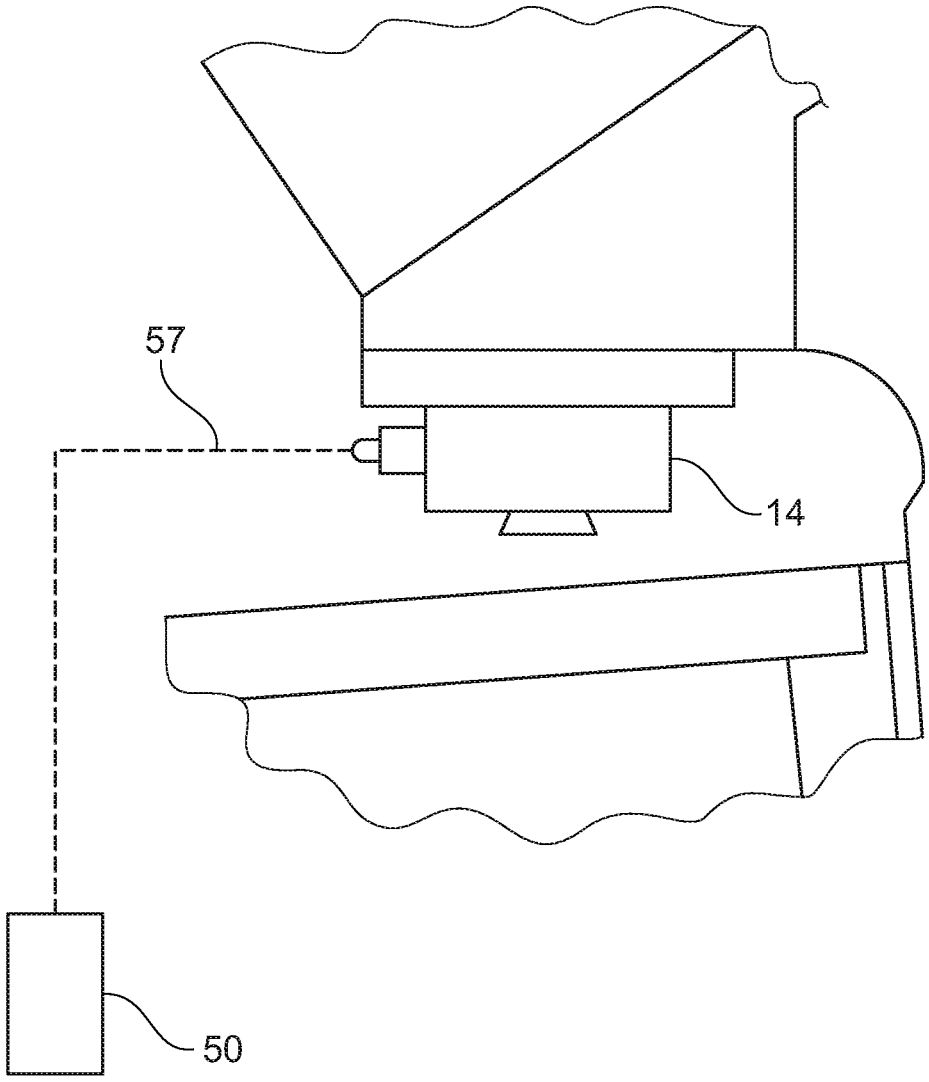
FIG. 13 is a side view illustrating a mechanical stop comprising a load sensor.

In preferred embodiments, at least one load sensor is used placed on each side of the press device (i.e. one load sensor on the drive side and one load sensor on the tender side of the machine). In principle, embodiments are also conceivable where more than one load sensor is located on each side of the press device (for example several load sensors placed on the tender side of the machine). The load sensor may be connected to a control device, for example the control device 50 that is used to control the source 16 of pressurized fluid. The control device may be programmed such that a signal from the load sensor causes the control device 50 to increase or decrease pressure in the internal chamber 47 of the support body 5 or the flexible hose(s) 15. With reference to FIG. 13, a load sensor that forms a mechanical stop 14 or a part of a mechanical stop 14 is connected to the control device 50 by a connection 57 that may be, for example, a wire but could also be a wire-less link.

Although FIG. 6 shows an arrangement where the second bearing housings 12 are moved toward the first bearing housings 9 in a turning movement, it should be understood that actuators 13 could in principle be placed on both sides of the press plane (i.e. both upstream of the press nip N and downstream of the press nip N). In such a design, the actuator 13 (or actuators 13) could be arranged to move the second bearing housings 12 towards the first bearing housings 9 in a linear movement instead of a turning/swinging movement. In such a design, the first bearing housings 9 would be connected to the second bearing housings 12 by means of actuators 13 on both sides of the press plane P and the forces from the press nip would be transmitted through the actuators 13.

When the mechanical stop 14 is formed by or comprises a load sensor and the at least one actuator 13 is activated, the following will happen. The second bearing housings 12 will start to move towards the first bearing housings 9. The load sensor will then be subjected to a load in the form of a compressive force. This is because the load sensor is squeezed between the first bearing housing 9 and the second bearing housing 12.

Let us now assume that the press device 1 is a press device 1 where the support body 5 is either formed by or supported by a flexible hose 15 extending in a cross machine direction and connected to a source of pressurized fluid 16 as described above with reference to FIGS. 2-4. Before the flexible hose 15 has been pressurized, there is no pressure in the actual press nip N since the support body has not yet been caused to expand or move radially outward in a direction toward the inner surface of the flexible jacket 4. The load sensor that forms the mechanical stop 14 (or forms a part of the mechanical stop 14) will then only register the compressive force that is caused by the at least one actuator 13.

Figure 7:
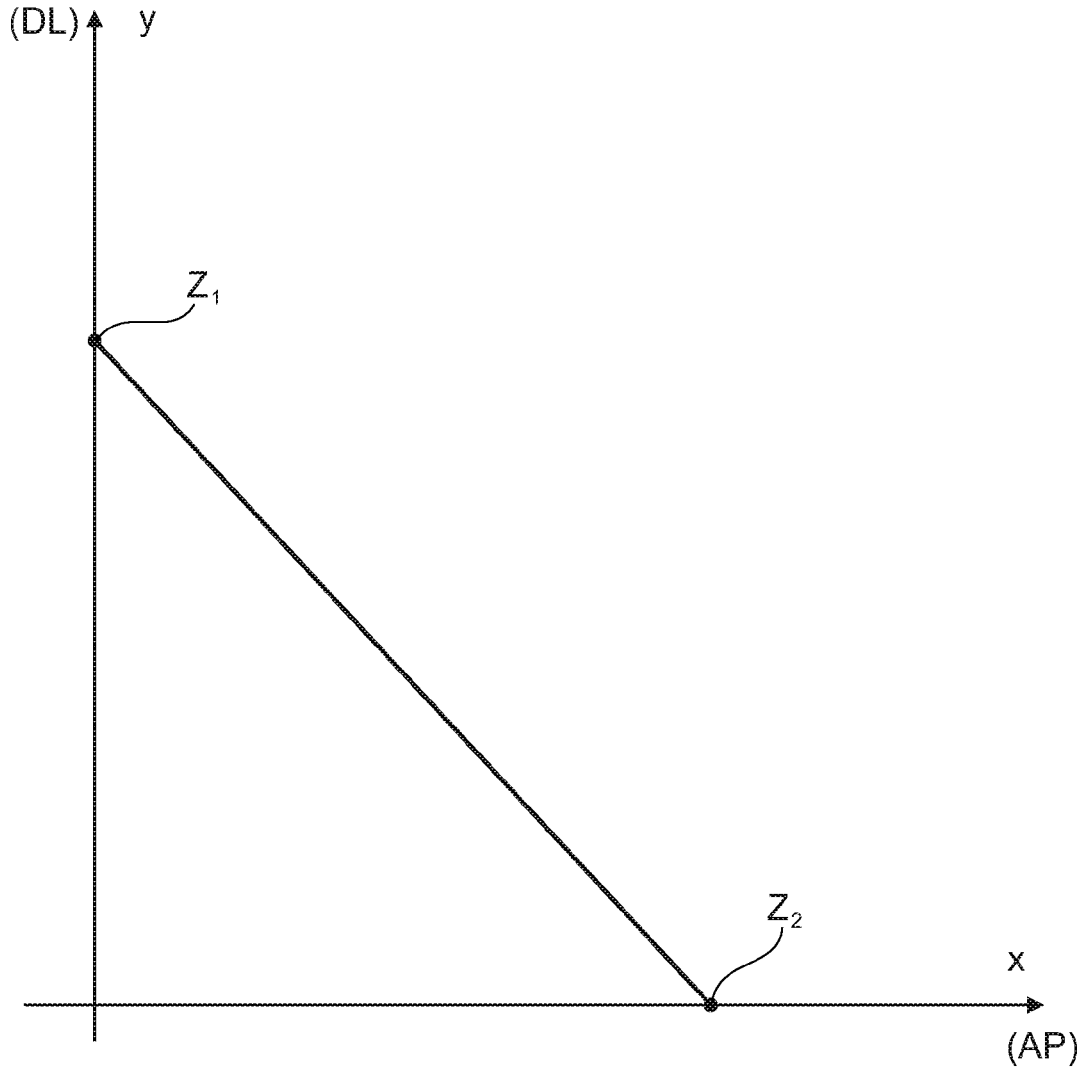
FIG. 7 is a schematic representation of the loaf detected by the load sensor as a function of the pressure in the press nip.

Reference will now be made to FIG. 7. In FIG. 7, the vertical axis (the y-axis) represents the load detected (detected load=DL) by the load sensor of the mechanical stop while the horizontal axis (the x-axis) represents actual linear load (corresponding to the average pressure AP in the actual nip) in the press nip N between the extended nip roll 2 and the counter roll 3. FIG. 7 shows the load registered by the load sensor(s) as a function of the linear load in the press nip N. The linear load depends on the pressure in the nip. It should of course be understood that pressure may vary in the machine direction. However, average pressure in the nip N can be assumed to be proportional to linear load. Initially, there is no pressure N in the press nip N and no linear load but the load sensor(s) will register a compressive force. As can be seen in FIG. 7, the load sensor(s) register(s) the higher load when the pressure in the nip N is zero (which of course means that linear load is also zero). This corresponds to the point $Z_1$ in FIG. 7. When the flexible hose that forms or supports a support body 5 is pressurized, this will cause the support body to move or expand radially outward in a direction toward the inner surface 6 of the flexible jacket 4 which will cause the flexible jacket 4 to be pressed against the counter roll 3. The pressure in the nip N will then start to rise. As a consequence of rising pressure in the nip N, the first bearing housings 9 will be pressed away from the second bearing housings 12. When this happens, the load registered by the load sensor(s) will decrease correspondingly. Therefore, FIG. 7 shows how the load registered by the load sensor(s) decreases as the pressure in the nip N increases (which results in a higher linear load). It can be added that the load registered by the load sensors will of course decrease as a function of the total force generated by the support body when it is pressed against the counter roll. However, the total force is directly proportional to the linear load for a given roll length. Eventually, the pressure in the nip N may become so high that the load registered by the load sensor(s) is zero which corresponds to the point $Z_2$ in FIG. 7. In practice, this will normally not happen since the force generated by the at least one actuator 13 is so high in relation to the pressure in the nip N that the load sensor(s) will always register a certain load which is greater than zero.

The load sensor(s) may be connected to a display that indicates the current load registered by the load sensor(s). By reading the value of the registered load, an operator of the press can determine the actual linear load or average pressure in the nip N since the load registered by the load sensor(s) is directly dependent on the linear load or average pressure in the nip N. The operator can therefore accurately determine the actual pressure in the nip N independently of the hydraulic pressure in the flexible hose(s) that form or support the support body 5. The operator can then use the control device 50 to adjust the actual pressure until the load sensor(s) indicate a correct value. Of course, this does not necessarily have to be performed by a human operator; the control device 50 may comprise a computer and be connected to the load sensor(s). Control of the linear load may then be achieved through suitable software in the computer.

In preferred embodiments of the invention, the actuator or actuators 13 is/are arranged to act on one side of the press plane P while the bearing housings 9, 12 are hingedly connected to each other by hinges 19 on the other side of the press plane P, either directly or through a connection beam 49 as shown in FIG. 6. Preferably, the at least one actuator 13 is arranged upstream of the press plane P, i.e. between the head box 33 and the press nip N. This location of the at least one actuator 13 is preferable since it will then not interfere with other equipment placed on the downstream side of the nip P, for example a doctor that may be placed against the counter roll. However, embodiments are conceivable where the at least one actuator 13 is placed on the downstream side of the press plane P.

In the embodiment shown in FIG. 6, the extended nip roll 2 is a lower roll and the counter roll 3 is an upper roll. It should be understood, however, that the invention may also work in embodiments where the extended nip roll is an upper roll or where both rolls 2, 3 have axes that are located on the same or approximately the same level.

In the embodiment of FIG. 6, the mechanical stop 14 is shown as a part that projects from the first bearing housing 9. It should be understood that it may instead comprise or be formed by a part that projects from the second bearing housings 12 or by parts projecting from both the first bearing housings 9 and the second bearing housings 12. The mechanical stop 14 may also comprise or be formed by a part of the machine frame which is completely separate from the bearing housings 9, 12 but projects into the area between the first bearing housings and the second bearing housings 12.

Figure 12:
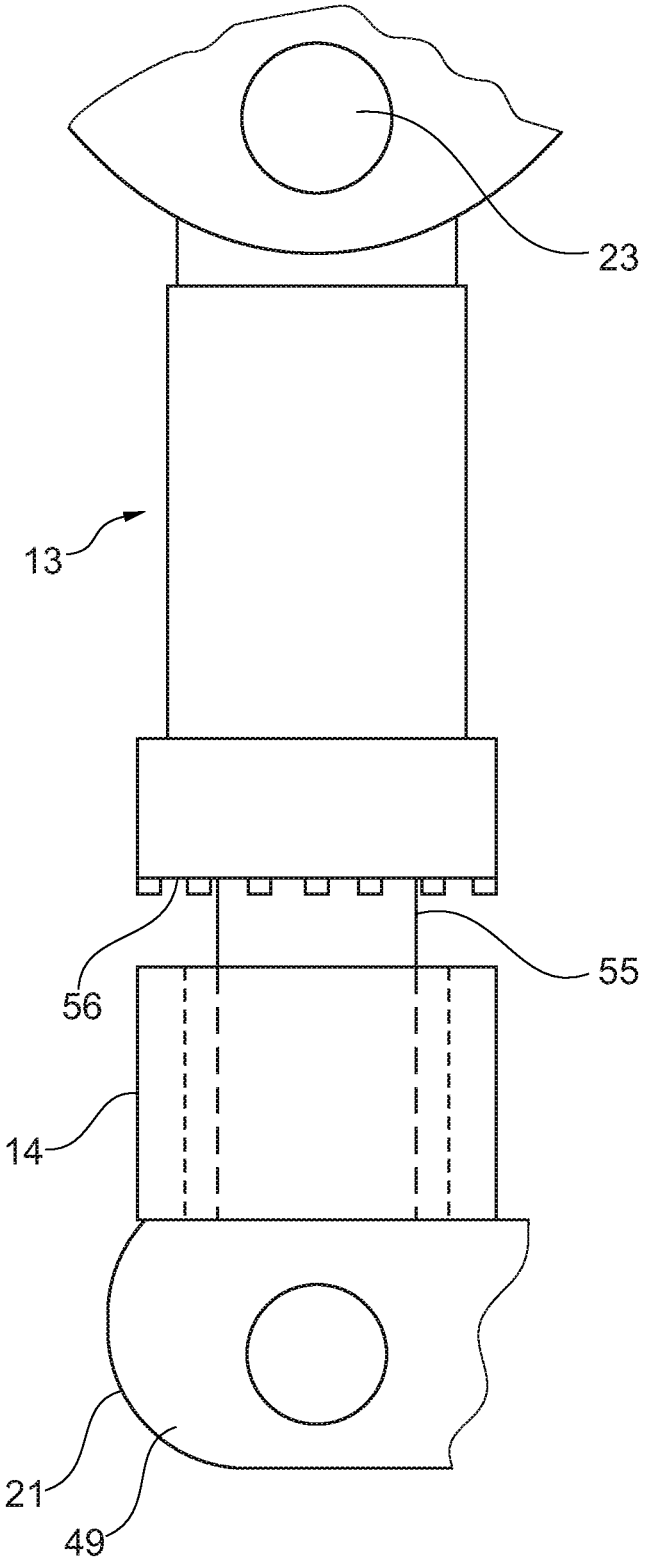
FIG. 12 shows an alternative embodiment of a mechanical stop.

Yet another way of achieving a mechanical stop will now be explained with reference to FIG. 12. In FIG. 12, the at least one actuator 13 that connects the first bearing housings 9 to the second bearing housings 12 is a hydraulic cylinder. The hydraulic cylinder has a piston 55 that is retracted when the actuator 13 acts on the bearing housings 9, 12 to achieve a closing movement. The mechanical stop 14 comprises or is formed by a collar that surrounds the piston 55. When the piston 55 is retracted, the collar will eventually abut against a part 56 of the hydraulic cylinder and prevent further retraction of the piston 55.

Another aspect of the invention will now be explained with reference to FIG. 6 and FIGS. 8-10.

As previously explained, the counter roll 3 may be a heatable roll which means that the press device 1 has means for heating the counter roll 3. The heating means may be, for example, an induction heater 44 placed adjacent the surface of the counter roll 3 as shown in for example FIG. 1. Other means for heating the counter roll 3 may of course also be used. For example, the counter roll 3 may be provided with internal channels (not shown) for a heating medium such as heated oil, hot water, hot gas or steam. The counter roll 3 may also use other external or internal heating means using convection, conduction or radiation as known to the skilled person (e.g. flame burners, electrical heaters, infrared heaters etc.). By heating the counter roll, dewatering in the press nip N may be improved (i.e. increased). In many realistic embodiments, the counter roll may be heated to a temperature of about 80° C.-95° C. (this refers to the surface temperature of the counter roll 3, i.e. the temperature of that part of the counter roll 3 that comes into contact with the web W). For example, it may be heated to a temperature of 82° C.-90° and in one suitable embodiment; the counter roll 3 may be heated to 85° or about 85° C.

At such temperatures, the heated counter roll 3 may cause damage to the water-receiving felt 37 if the press device is stopped for any reason (and embodiments are also possible where the counter roll 3 may be heated to temperatures over 95° C.).

For the sake of completeness, it should be explained that the felt may actually take damage also at temperatures below 80° C. Whether the felt is damaged by heat or not depends also on the properties of the felt itself and on the time during which it is exposed to heat. It should also be understood that, during the process of papermaking, a roll may be heated to a surface temperature that is below 80° C. and such temperatures may still (in some cases) cause damage to felts.

In practice, it is quite often the case that a press must be stopped. This may have many reasons. This may be the case, for example, when there are problems due to poor quality of the pulp or because a felt or a forming wire needs cleaning before operation can be resumed. Another reason may be malfunction in the pumps used for feeding pulp to the head box. Especially when a new machine is started up, operation of the machine may be interrupted frequently, in some cases many times per day. In a machine for making tissue paper, the shut-down sequence may be as follows. First, the paper web is caused to pass from the Yankee cylinder into the pulper and the reel-up is stopped. In a second step, the pump or pumps that feed pulp to the head box is/are stopped. In a third step, the drive for the forming section and the press section is either stopped or caused to reduce its speed. This means that the felt will no longer be moving or move at a much lower speed. If the felt is then in contact with a heated roll, the felt may be damaged. During normal operation of the press, the felt is protected by the wet fibrous web W and by the fact that the felt 37 is moving during normal operation with a speed of several hundred meters per minute. For example, a tissue machine in which the inventive press device may be used can run at a speed in the range of (for example) 1500 m/min-2300 m/min. When operation is to be stopped, the speed may be reduced to less than 100 m/min, perhaps to a speed of only 1-3 m/min or the speed may be reduced to zero. If the felt 37 is in contact with a heated roll more than a short moment, the textile fibers in the felt 37 will quickly be damaged.

To prevent this from happening, the nip N must be opened such that the felt 37 can be separated from the heated counter roll 3. To this end, the at least one actuator 13 can be activated to move the extended nip roll 2 away from the counter roll 3 (i.e. the at least one actuator 13 is extended). In the embodiment of FIG. 6, the extended nip roll 2 is a lower roll and it is located inside the loop of the felt 37. Therefore, it also acts as a guide roll for the felt 37. If the extended nip roll 2 is moved away from the counter roll 3, the felt 37 will also move away from the counter roll 3.

Figure 8:
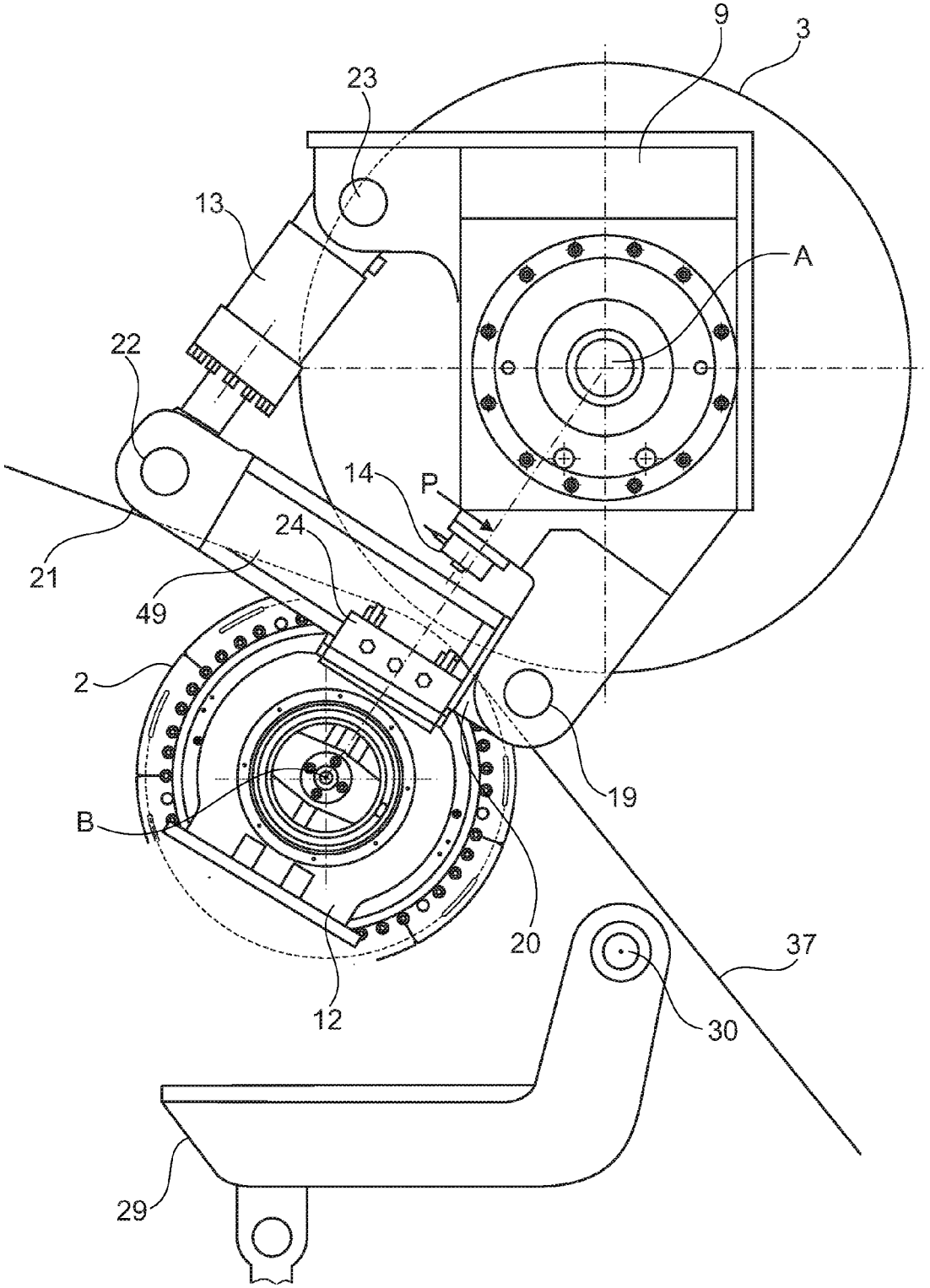
FIG. 8 is a side view corresponding to FIG. 6 but in which the nip has been opened.

FIG. 6 represents a situation corresponding to normal operation of the press device 1. If the press is to be stopped, pumps that feed stock to the head box 33 will be stopped and the speed of the felt 37 will be reduced. The pressure in the flexible hose(s) that form or support the support body 5 is reduced to zero. Before the speed of the felt 37 has been reduced to zero (i.e. while the felt 37 is still moving), the at least one actuator 13 is activated such that the second bearing housings 12 move away from the first bearing housings 9. This is illustrated in FIG. 8 where the at least one actuator 13 has been activated such that the connection beam 49 has been caused to turn about the hinge 19 that connects a first end 20 of the connection beam 49 to the first bearing housing on each side (this means that the connection beam turns counterclockwise in FIG. 8). Thereby, the felt 37 will also be separated from the hot counter roll 3 by a certain distance. This distance may very well be a small distance but may still be enough to prevent heat damage to the felt 37 (or at least reduce the risk thereof). It will be noted that, in the embodiment of FIG. 6 and FIGS. 8-10, the connection beam 49 has a second end 21 at which second end 21 the at least one actuator 13 is connected to the connection beam 49 by a hinge 22.

The heated counter roll may preferably continue to rotate at a low speed even after the bearing housings 9, 12 have been separated from each other.

Figure 9:
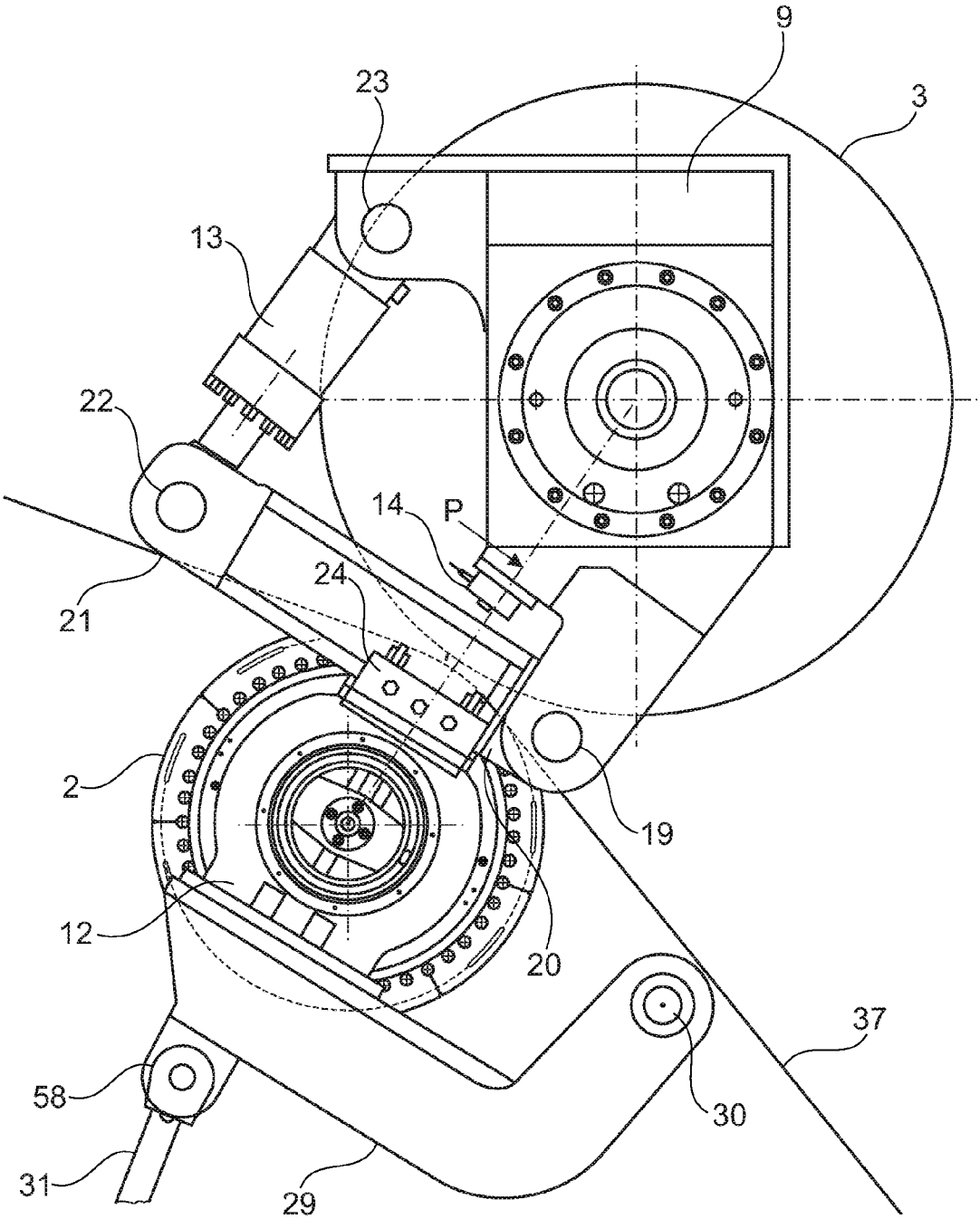
FIG. 9 is a side view corresponding to FIG. 8 but further showing how a service bracket has been brought to receive the lower roll.
Figure 10:
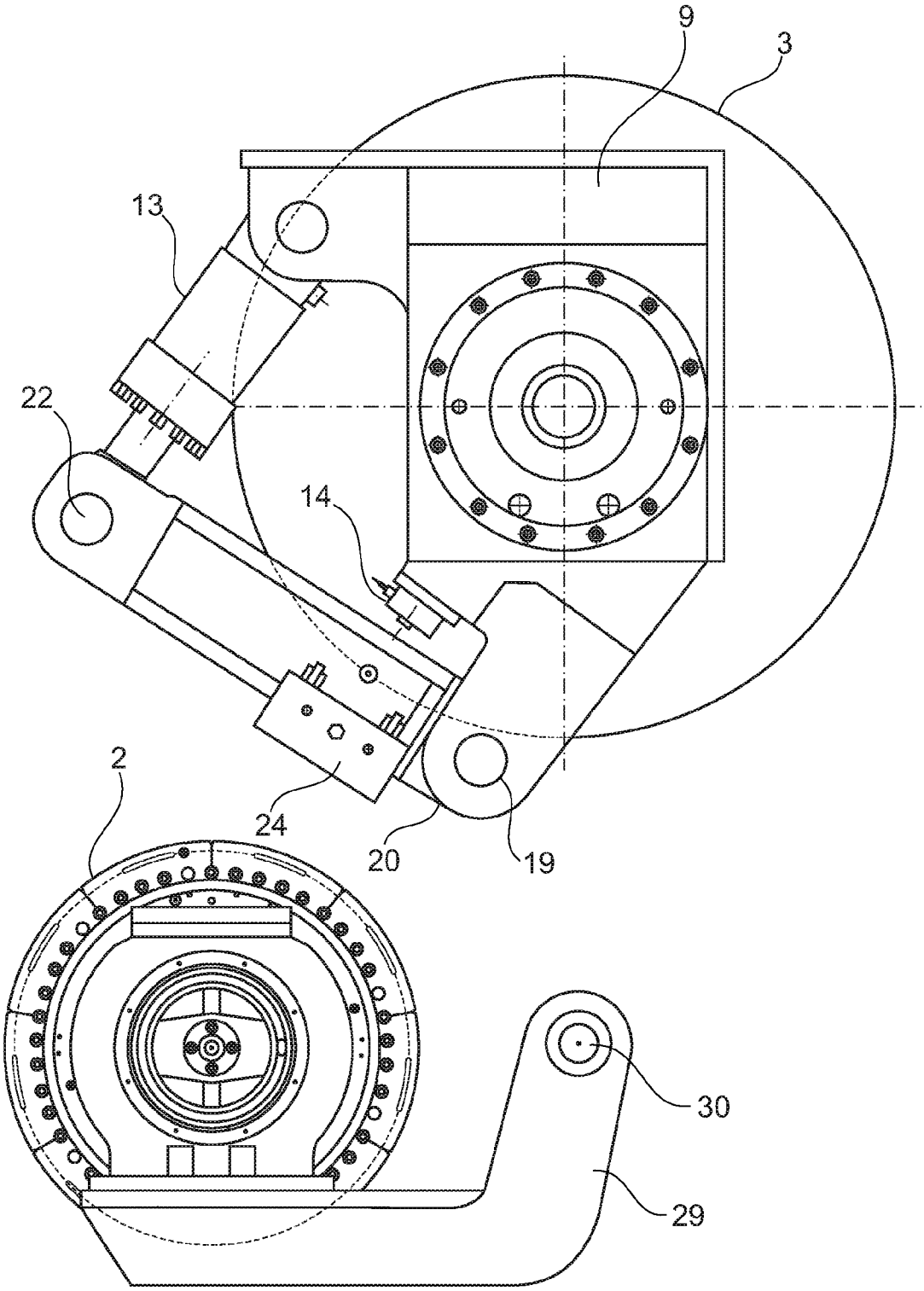
FIG. 10 is a side view corresponding to FIG. 9 but further showing the complete separation of the bearing housings.

To perform service operations, the extended nip roll 2 and its bearing housings 12 can be completely separated from the counter roll. In FIG. 9, it is shown how a service bracket 29 is moved from a lower position to a position where it can support a lower part of the second bearing housing 12 (it should be understood that such a service bracket may be of course arranged on both the tender side and the operator side of the machine). As indicated in FIG. 9, the service bracket 29 may be connected to a stationary object (for example the machine frame) by a hinge 30 at one end of the service bracket 29. An actuator 31 (for example a hydraulic cylinder) is connected to the other end of the service bracket 29. The actuator 31 may be connected to the service bracket 29 by a hinge connection 58. The actuator 31 can be activated to lift the service bracket 29 into the position indicated in FIG. 9. In this position, the service bracket supports the second bearing housing 12 on each side of the press device. The connection beam 49 that connects the at least one actuator 13 and the first bearing housing 9 to the second bearing housing on each side can then be disconnected from the second bearing housing 12. Thereafter, the service bracket 29 can be lowered by means of its actuator 31. Thereby, the extended nip roll and its bearing housings 12 will be lowered together with the service bracket 29. This is illustrated in FIG. 10.

Figure 11:
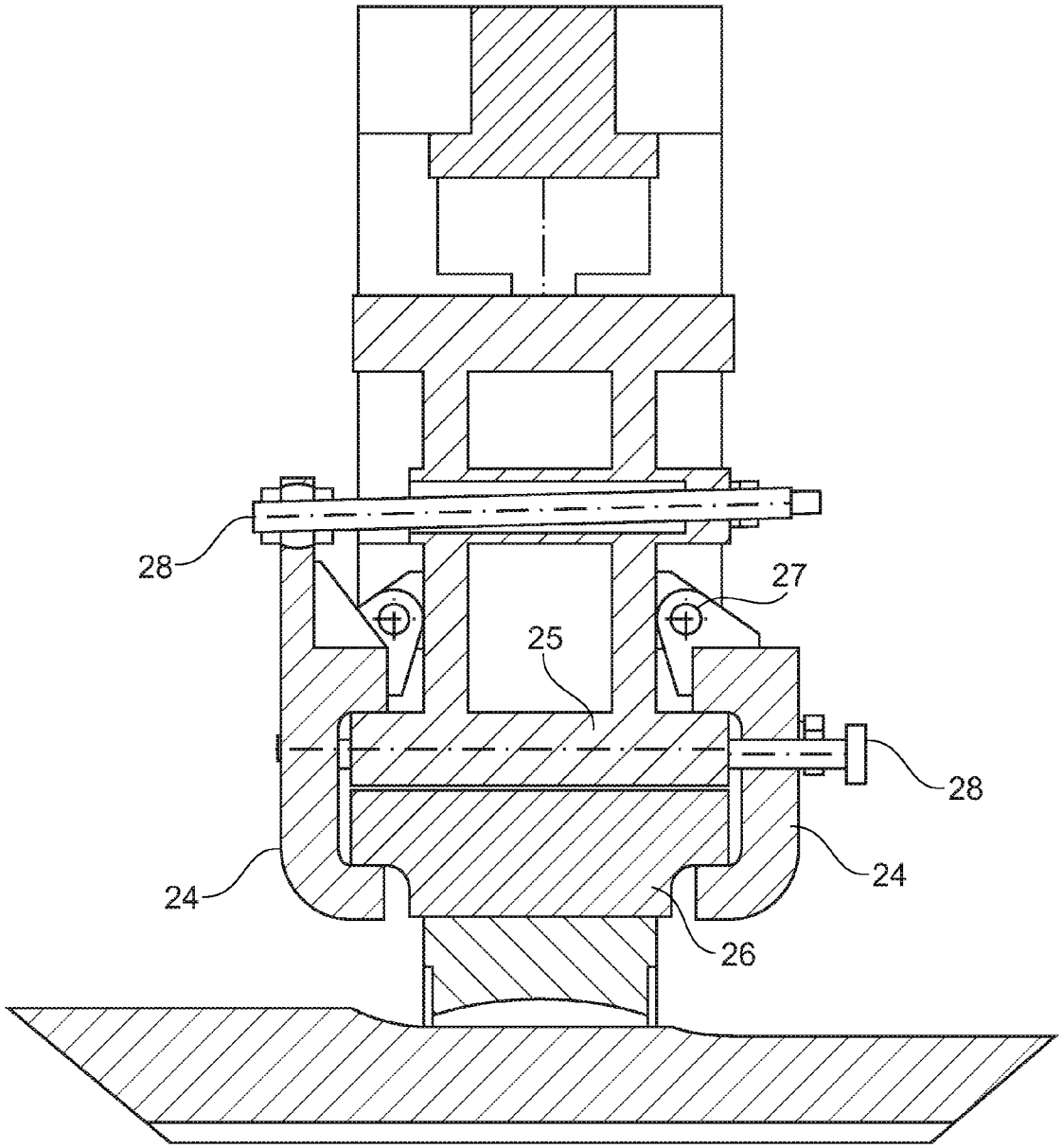
FIG. 11 is a cross sectional view that illustrates an embodiment of an attachment device for attaching the connection beam to the second bearing housing on each axial end.

As previously stated, the connection beam 49 is detachably connected to the second bearing housing 12. This can be achieved by means of special attachment means 24 as will be explained with reference to FIG. 11. The arrangement of FIG. 11 may be substantially similar to an arrangement disclosed in U.S. Pat. No. 5,547,547. As shown in FIG. 11, the attachment means 24 comprises two substantially C-shaped clamps that are used to connect the connection beam 49 to the second baring housing 12. The second bearing housing 12 may have an upper flange 26 against which the connection beam 49 may be placed. The connection beam 49 in turn has a lower flange 25 that rests on the upper flange 26 of the second bearing housing 12. The C-shaped clamps of the attachment means 24 may be connected to the connection beam 49 by hinges 27. To secure the C-clamps in their position, elements 28 such as screws or bolts may be used. These elements can be loosened and/or removed such that the C-shaped clamps can be opened such that the connection beam 49 can be detached from the bearing housing 12.

Although the invention has been explained above with reference to such embodiments where the first bearing housings 9 are in a fixed position while the second bearing housings 12 are movable, it should be understood that embodiments are also conceivable where the second bearing housings 12 are in a fixed position while the first bearing housings 9 can be moved by the at least one actuator 13 towards the (fixed) second bearing housings 12.

In principle, embodiments are even conceivable where both the first bearing housings 9 and the second bearing housings 12 are movable towards and away from each other even though it is preferable that either the first bearing housings 9 or the second bearing housings 12 be arranged in a fixed position.

Although described in terms of a press device, the invention can also be understood in terms of a method of operating a press device in such a way that the pressure/the linear load in the press nip N does not exceed a predetermined level (a maximum permitted value for linear load/nip pressure). Such a method may comprise the steps of using the inventive press device and using the at least one actuator 13 that connects the bearing housings 9, 12 to perform a closing movement until the closing movement is halted by the mechanical stop 14; and finally cause the support body 5 to be pressed against the inner surface 6 of the flexible jacket 4 such that the flexible jacket 4 moves towards the counter roll 3 to exert pressure in the nip N. Such a method may comprise any and all steps and actions that would be the natural consequence of using the inventive press device or parts thereof, irrespective of whether such steps or actions have been explicitly mentioned in this description or not.

The invention can also be understood in terms of a method for monitoring and controlling the linear load (and thereby also the pressure in the nip N). Such a method may comprise the steps of using the embodiment where the mechanical stop 14 is formed by or comprises a load sensor, monitoring the load registered by the load sensor, comparing the registered load to a nominal value (set point) and, if the registered load differs from the nominal value, adjusting the pressure in the internal chamber 47 of the flexible hose(s) 15 or the support body 5 until the load registered by the load sensor(s) is the same as the nominal value.

Suitably, the pressure in the internal chamber 47 of the support body 5 or the flexible hose(s) 15 may be adjusted by the control device 50.

The invention may further be understood in terms of a method of stopping the operation of a press with a heated counter roll. In such a method, the mechanical stop may or may not comprise a load sensor. Such a method may comprise the steps of initially using the inventive press device in a machine of the kind disclosed in FIG. 1 and operating the press device such that the counter roll 3 is heated to a surface temperature of at least 80° C. or higher. For example, the surface temperature of the counter roll 3 may be in the range of 80° C.-300° C., in the range of 80° C.-180° C. or in the range of 80° C.-100° C. The method of stopping the operation may then further comprise the steps of causing the paper web W to pass from the Yankee cylinder down into the pulper, stopping the pump or pumps that send stock to the head box 33; reducing the speed of the felt 37 (or completely stopping the felt); and activating the at least one cylinder 13 to cause the second bearing housings 12 and their extended nip roll to move away from the heated counter roll 3, thereby causing the felt 37 to also move away from the heated counter roll 3.

The invention can also be understood in terms of a paper making machine that includes the inventive press device.

Although the invention has been described with reference to a press having an extended nip where the support body 5 that either comprises, is formed by or is supported by a flexible hose, the inventive principle for determining linear load could in principle be used for all kinds of presses. However, it is for presses of the kind disclosed in FIGS. 2-4 that the invention will be truly useful.

It should be understood that the inventive solution for separating the bearing housings from each other can be used independently of whether a load sensor is placed between the bearing housings or not. The invention can also be understood in terms of a method of separating the bearing housings from each other.

A technical problem that may occur for press devices having a support body 5 that comprises (or is formed by) or supported by one or several flexible hoses is that the support body 5 (or the flexible hose or hoses supporting it) may be pressurized before the nip is properly closed. This may cause the support body 5 or the flexible hose(s) 15 to burst. To prevent this from happening, the control device 50 may be programmed such that pressurization of the internal chamber(s) 47 is not permitted before the load sensor has given a signal that the closing movement has been halted by the mechanical stop 14. In a similar way, the control device 50 may be programmed to reduce the pressure in the internal chamber(s) 47 before the at least one actuator 13 is activated to perform an opening movement to separate the rolls 2, 3 from each other.

It should be understood that, while the counter roll 3 is preferably a heated roll (or heatable roll), embodiments are possible where the counter roll 3 is not heated and where the press device has no means for heating the counter roll 3.

The invention claimed is:

1. A press device (1) comprising:

an extended nip roll (2); and a counter roll (3), wherein:

the extended nip roll (2) comprises a flexible jacket (4) and a support body (5) inside the flexible jacket (4);

the extended nip roll (2) comprises internal means for causing the support body (5) to move or expand radially towards an inner surface (6) of the flexible jacket (4) to form a nip with the counter roll (3);

the counter roll (3) comprises axial ends (7, 8) supported in first bearing housings (9);

the extended nip roll (2) comprises axial ends (10, 11) supported in second bearing housings (12);

at least one actuator (13) connects the first bearing housings (9) to the second bearing housings (12) and the at least one actuator (13) is configured to be capable of acting on the bearing housings (9, 12) to cause the bearing housings (12) of at least one of the rolls (2) to move at least one of towards the bearing housings (13) of the other roll (3) in a closing movement or away from the bearing housings of the other roll (3) in an opening movement; and a mechanical stop (14) separate from the rolls (2, 3) is configured to halt the closing movement when the closing movement has brought the rolls (2, 3) so close to each other that the axial ends (10, 11) of the extended nip roll (2) and the axial ends (7, 8) of the counter roll (3) are at a predetermined distance from each other.

2. A press device according to claim 1, wherein the mechanical stop is formed by at least a part of the bearing housing (9, 12) for each axial end (7, 8, 10, 11) of a roll (2, 3).

3. A press device according to claim 1, wherein the actuator (13) is a hydraulic cylinder with a piston.

4. A press device according to claim 3, wherein the mechanical stop (14) is configured to halt the piston before the piston has reached a completely retracted position.

5. A press device according to claim 1, wherein the mechanical stop (14) comprises at least one load sensor that is arranged between one of the first bearing housings (9) and one of the second bearing housings (12).

6. A press device according to claim 1, wherein the support body (5) either comprises or is supported by a flexible hose extending in a cross machine direction and connected to a source of pressurized fluid (16) such that pressurization of the flexible hose will cause the support body (5) to expand or move radially in a direction towards the inner surface (6) of the flexible jacket (4).

7. A press device according to claim 1, wherein an actuator (13) is connected to each bearing housing (9, 12) of a roll (2, 3).

8. A press device according to claim 1, wherein:

the rolls (2, 3) have axes (A, B) that define a press plane; and the at least one actuator (13) is configured to act on one side of the press plane while the bearing housings (9, 12) are hingedly connected to each other on the other side of the press plane.

9. A press device according to claim 8, wherein, at each roll end, the at least one actuator (13) is connected to the respective second bearing housing (12) through a connection beam (49) that is hingedly connected to the first bearing housing (9) at a first end (20) of the connection beam (49) and hingedly connected to the at least actuator (13) at a second end (21) of the connection beam (49).

10. A press device according to claim 9, wherein, at each roll end, the at least one actuator (13) is hingedly connected to the first bearing housing (9) and to the second end (21) of the connection beam (49).

11. A press device according to claim 9, wherein, at each roll end, the connection beam (49) is detachably connected to the second bearing housing (12).

12. A press device according to claim 1, wherein the extended nip roll (2) is a lower roll and the counter roll (3) is an upper roll.

13. A press device according to claim 1, wherein the counter roll is a heatable roll (3).

14. A paper making machine having a head box (33) and a press device (1), wherein the press device being designed according to claim 8 and the at least one actuator (13) is located upstream of the press plane.

15. The paper making machine of claim 14, wherein the at least one actuator is located between the head box and the press plane.

16. A method of operating a press device according to claim 1, wherein the method comprises the steps of using the at least one actuator (13) that connects the bearing housings (9, 12) to perform a closing movement until the closing movement is halted by the mechanical stop (14); and finally cause the support body (5) to be pressed against the inner surface (6) of the flexible jacket (4) such that the flexible jacket (4) moves towards the counter roll (3) to exert pressure in the nip (N).

* * * * *